US009353497B2

(12) United States Patent
Vu

(10) Patent No.: US 9,353,497 B2
(45) Date of Patent: May 31, 2016

(54) METHODS AND APPARATUS FOR CONVERTING AN OFFSHORE STRUCTURE

(71) Applicant: ENSCO International Incorporated, Wilmington, DE (US)

(72) Inventor: Van Vu, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 95 days.

(21) Appl. No.: 14/033,987

(22) Filed: Sep. 23, 2013

(65) Prior Publication Data

US 2015/0086275 A1 Mar. 26, 2015

(51) Int. Cl.
*E02B 17/02* (2006.01)
*E02B 17/00* (2006.01)

(52) U.S. Cl.
CPC ..... *E02B 17/021* (2013.01); *E02B 2017/006* (2013.01); *E02B 2017/0039* (2013.01); *E02B 2017/0043* (2013.01); *E02B 2017/0073* (2013.01); *E02B 2017/0086* (2013.01)

(58) Field of Classification Search
USPC ..... 405/199, 204
See application file for complete search history.

(56) References Cited

U.S. PATENT DOCUMENTS

| | | | | |
|---|---|---|---|---|
| 3,138,932 | A * | 6/1964 | Kofahl et al. | 405/209 |
| 4,265,568 | A * | 5/1981 | Herrmann et al. | 405/196 |
| 4,511,288 | A * | 4/1985 | Wetmore | 405/217 |
| 5,190,410 | A * | 3/1993 | Nunley | 405/196 |
| 5,551,801 | A * | 9/1996 | Gallaher et al. | 405/204 |
| 5,807,028 | A * | 9/1998 | Manschot et al. | 405/197 |
| 2012/0063850 | A1* | 3/2012 | Collins | 405/205 |
| 2012/0125688 | A1* | 5/2012 | Noble et al. | 175/57 |

* cited by examiner

*Primary Examiner* — Benjamin Fiorello
*Assistant Examiner* — Kyle Armstrong
(74) *Attorney, Agent, or Firm* — Fletcher Yoder, P.C.

(57) ABSTRACT

An offshore support system comprises an offshore structure having a platform supported by one or more legs. The system further comprises a mat structure having a mat, and a clamp configured engage at least one leg of the offshore structure. The clamp is movable into and out of engagement with the leg to connect and release the mat to and from the offshore structure.

19 Claims, 8 Drawing Sheets

METHODS AND APPARATUS FOR CONVERTING AN OFFSHORE STRUCTURE

BACKGROUND OF THE INVENTION

1. Field of the Invention

Embodiments of the invention generally relate to methods and apparatus for converting offshore structures between a concentrated load configuration and a distributed load configuration.

2. Description of the Related Art

Offshore structures are designed using either a concentrated load configuration or a distributed load configuration. Concentrated load offshore structures are most effectively used in applications where the seabed has a high bearing capacity soil to support the concentrated point loads or where soil layers below seabed provide sufficient support after structure penetrating the seabed. A concentrated load offshore structure may not be properly supported if the concentrated point loads are inserted into a low bearing capacity soil. Distributed load offshore structures, however, are most effectively used where the seabed has a low bearing capacity soil. The loads are distributed across the surface of the low bearing capacity soil using a supporting mat structure. Conversely, a distributed load offshore structure may not be the most efficient structure for use in high capacity bearing soil applications when compared to a concentrated load design, due to the additional expense and size of building the supporting mat structure. An operator involved with projects in both high bearing and low bearing capacity type soils must invest in two separate offshore structure designs to effectively and efficiently handle both applications.

There is a need, therefore, for offshore structures that can be converted between a concentrated load configuration and a distributed load configuration.

SUMMARY OF THE INVENTION

An offshore support system, comprising an offshore structure having one or more legs, and a platform supported by the legs; and a mat structure having a mat, and a clamp configured engage at least one leg of the offshore structure, the clamp movable into and out of engagement with the leg to connect and release the mat to and from the offshore structure.

A method of connecting a mat structure to an offshore structure, comprising positioning at least one leg of the offshore structure into alignment with a clamp of the mat structure; moving the clamp into engagement with the leg to connect the mat structure to the offshore structure while offshore; and lowering the mat structure onto the seafloor.

BRIEF DESCRIPTION OF THE DRAWINGS

So that the manner in which the above recited features of the embodiments of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention include an offshore structure that can be converted for use in both high bearing and low bearing capacity soil applications. The offshore structure can be converted from being supported by a concentrated load to being supported by a distributed load, and vice versa. The offshore structure can be converted offshore and does not need to be brought back to land for adjustment.

Offshore structures are generally designed to be supported using a concentrated (or point) load or a distributed load. Offshore structures supported using a concentrated load are effectively used in applications where the seabed has a high bearing capacity soil, usually found in deep waters. In particular, the offshore structure generally includes a platform that is supported by legs that are inserted into the seabed. The concentrated load at each leg may force the leg too far into the seabed to support the platform if the seabed is unstable and has a low soil bearing capacity. Thus concentrated load structures are more suitable in applications where the seabed is generally more solid and compact.

Offshore structures supported using a distributed load are effectively used in applications where the seabed has a low bearing capacity soil, usually found in shallow waters. In particular, the offshore structure generally includes a platform that is supported by legs, which are supported by a mat that is positioned on top of the seabed. The loads supported by the legs are distributed across the mat and onto the seabed. The mat is effectively used for seabeds having low soil bearing capacity since the mat sits on top of the seabed and is not needed to be inserted into the seabed.

Figure 1:
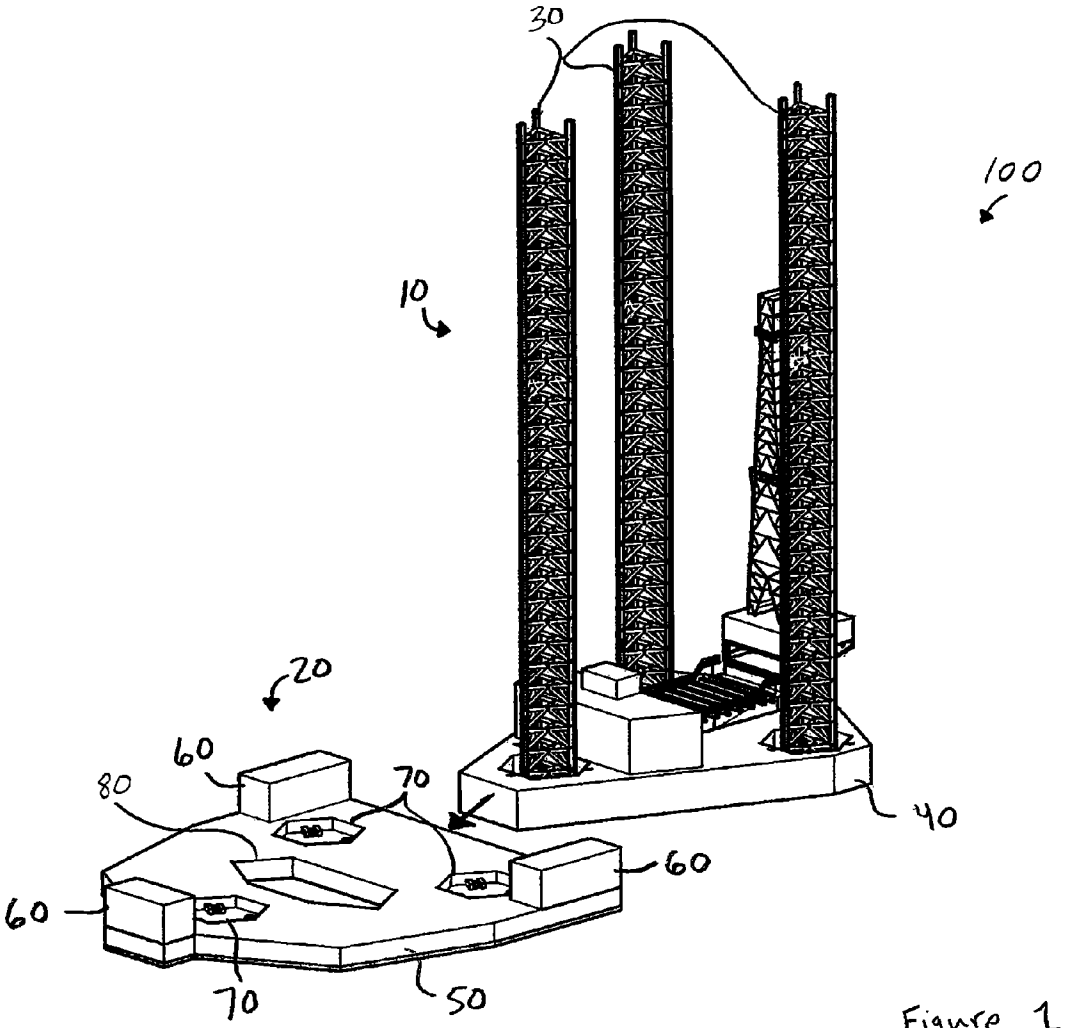
FIGS. 1, 2, and 3 illustrate an operational sequence of an offshore support system according to one embodiment.

FIG. 1 illustrates an offshore support system 100 comprising an offshore structure 10 and a mat structure 20. The offshore structure 10 may be used separately from the mat structure 20. In one embodiment, the offshore structure 10 may be an independent leg jack up rig.

The offshore structure 10 may be supported using a concentrated load design. In particular, the offshore structure 10 may include one or more legs 30 and a hull 40 or other similar type of platform that can be raised relative to the legs 30. The offshore structure 10 may be floated offshore, and may be secured by lowering the legs 30 into the seabed and raising the hull 40 above the water surface. The load of the offshore structure 10 is concentrated at each leg 30. Offshore activities known in the art, such as oil and gas exploration activities, may be conducted using the offshore structure 10.

The offshore structure 10 can be converted from a concentrated load support system to a distributed load system using the mat structure 20. The mat structure 20 may be connected to the legs 30 of the offshore structure and positioned on top of the seabed. The load from the legs 30 may be distributed across the mat structure 20.

FIG. 1 illustrates the mat structure 20 comprising a mat 50, one or more stability caissons 60, one or more locking mechanisms 70, and one or more openings 80 formed in the body of the mat 50. As illustrated in FIG. 1, the mat structure 20 includes three stability caissons 60 positioned at outermost edges of the mat 50; three locking mechanisms 70 positioned to align with the legs 30 of the offshore structure 10; and a single opening 80 disposed in the center of the mat 50. The mat structure 20 may be secured to the offshore structure 10 to convert the offshore structure 10 to a distributed load support system.

The mat 50 may be a substantially flat, rigid, plate-type support structure for supporting one or more loads. The mat 50 may be formed from a single piece of material, or may be formed from two or more pieces of materials coupled together such as by welding, bolting, or other ways known in the art. The mat 50 may be formed in any shape and size known in the art, and can be retrofitted to any existing structure, such as the offshore structure 10. Similarly, the mat 50 may include any number, shape, size, and arrangement of openings 80 to minimize resistance and suction by enabling fluid flow through the mat 50 when being lowered and raised to and from the seafloor.

The stability caissons 60 may be any floating-type structure that can be coupled to the mat 50 in any manner known in the art. Any number, shape, size, and arrangement of stability caissons 60 may be coupled to the mat 50 for buoyancy and stability purposes. The stability caissons 60 may be used to float the mat 50 to any offshore structure and stabilize the mat 50 for connection to the offshore structure.

The locking mechanisms 70 may be coupled to the mat 50 in any manner known in the art. Any number, shape, size, and arrangement of locking mechanisms 70 may be coupled to the mat 50 for connection to any offshore structure. The locking mechanisms 70 may be used to lock the mat 50 to the offshore structure 10 and thereby convert the offshore structure 10 to a distributed load support system.

Figure 2:
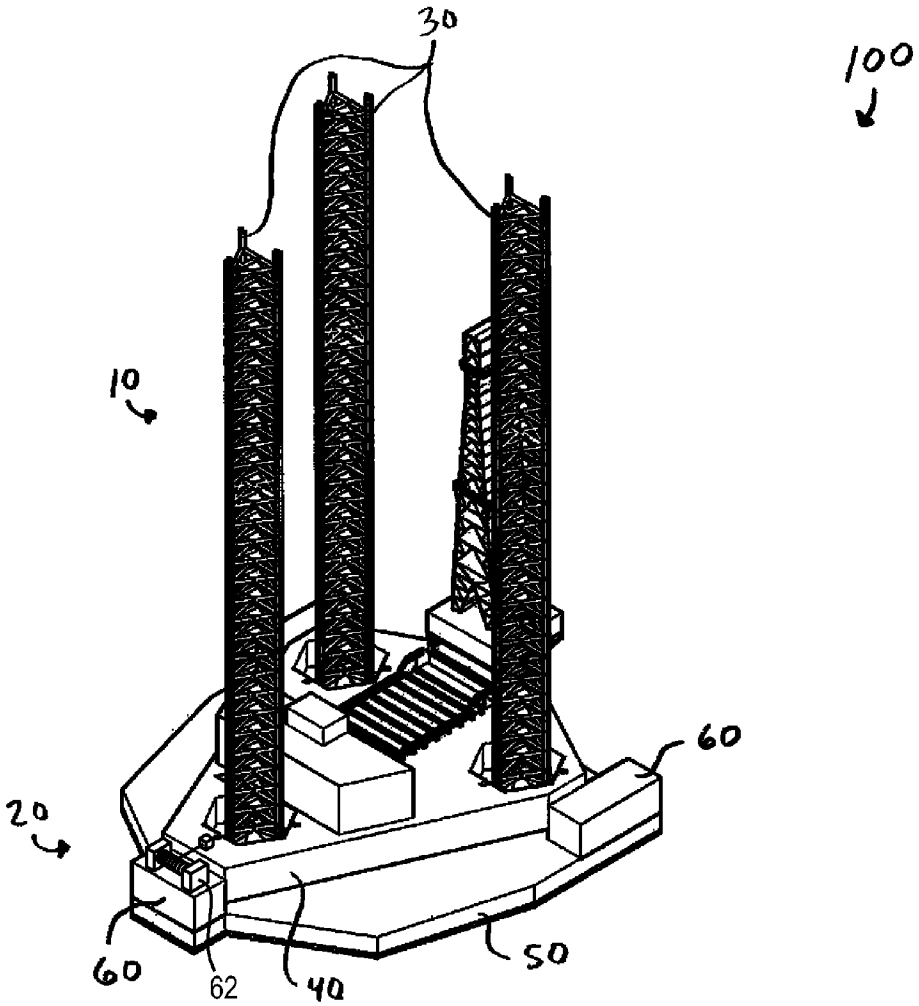
Figure 3:
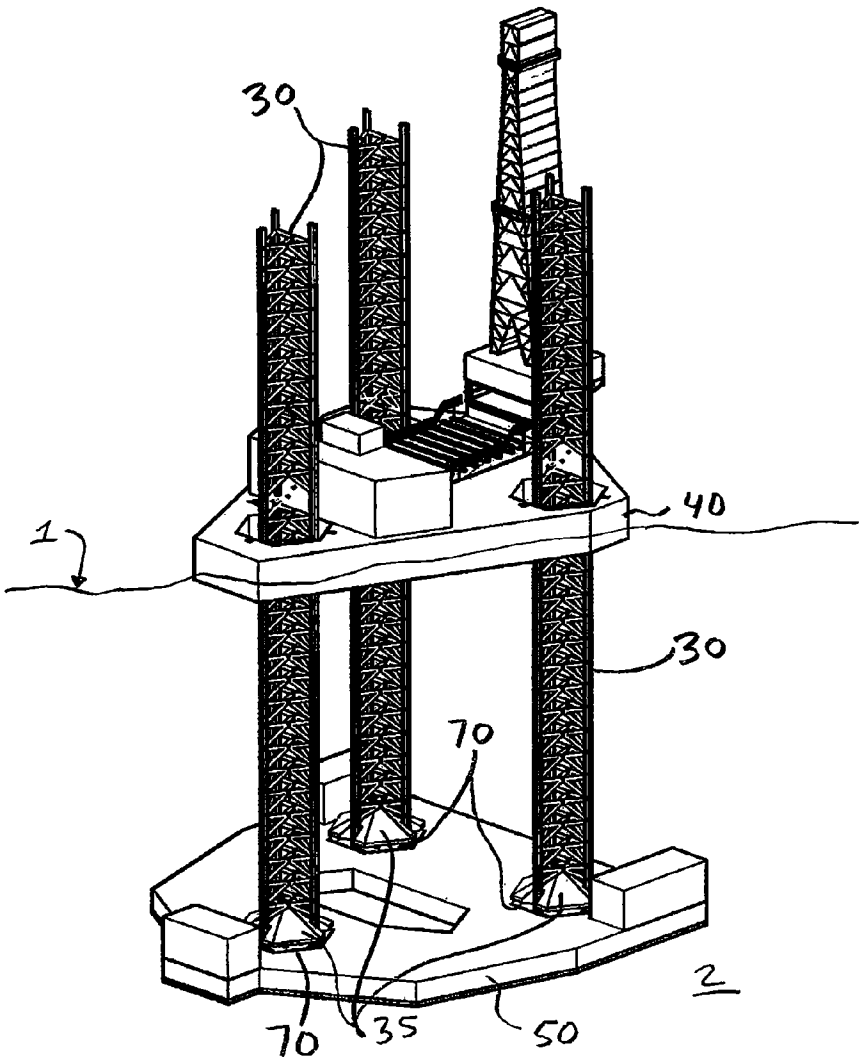

FIGS. 1, 2, and 3 illustrate the connection of the mat structure 50 to the offshore structure 10 according to one embodiment. Referring to FIG. 1, the legs 30 of the offshore structure 10 may be retracted to a position where the hull 40 is located at the base of each leg 30. The offshore structure 10 may be floating offshore such that a lower section of the hull 40 is submerged underwater, while the upper section of the hull 40 and the legs 30 are above water. Similarly, the mat structure 50 may be floating offshore such that the mat 50 and the lower sections of the stability caissons 60 are submerged underwater, while the upper sections of the stability caissons 60 are above water. In these floating positions, the hull 40 may be moved over the submerged mat 50 and between the stability caissons 60.

FIG. 2 illustrates the hull 40 moved on top of the mat 50. The bottom of the hull 40 may be submerged in the water at a higher level than the mat 50 so that the hull 40 may be easily floated over and on top of the mat 50. The legs 30 may also be retracted to a position where they do not interfere with positioning of the hull 40 on the mat 50. The stability caissons 60 aid in stabilizing and maintaining the mat 50 in a substantially level position for alignment and connection of the legs 30 to the locking mechanisms 70. In addition, the stability caissons 60 may aid in guiding and aligning the hull 40 onto the mat 50. In one embodiment, one or more of the stability caissons 60 may include generators, pulleys, and/or winches 62 to pull the offshore structure 10 and the mat structure 20 together. When in proper position, the legs 30 may be secured to the mat 50 using the locking mechanisms 70.

FIG. 3 illustrates the legs 30, after they are secured to the mat 50, actuated into an extended position to lower the mat 50 onto the seafloor 2 and support the hull 40 at the water surface 1. Fluid may flow through the one or more openings 80 of the mat 50 to minimize resistance when lowering the mat 50 to the seafloor 2. The base 35 of each leg 30 connects to the corresponding locking mechanism 70. The load of the offshore structure 10 is distributed across the mat 50. In this manner, the offshore structure 10 can be converted out at sea from a concentrated load support system to a distributed load support system.

The above described process can be reversed to convert the offshore structure 10 back to a concentrated load support system. In particular, the legs 30 can be raised to bring the mat 50 back near the water surface adjacent the hull 40. The locking mechanisms 70 can be actuated to release the base 35 of each leg 30. The offshore structure 10 then can be moved away from the mat structure 20 for use as a concentrated load support system.

Figure 4:
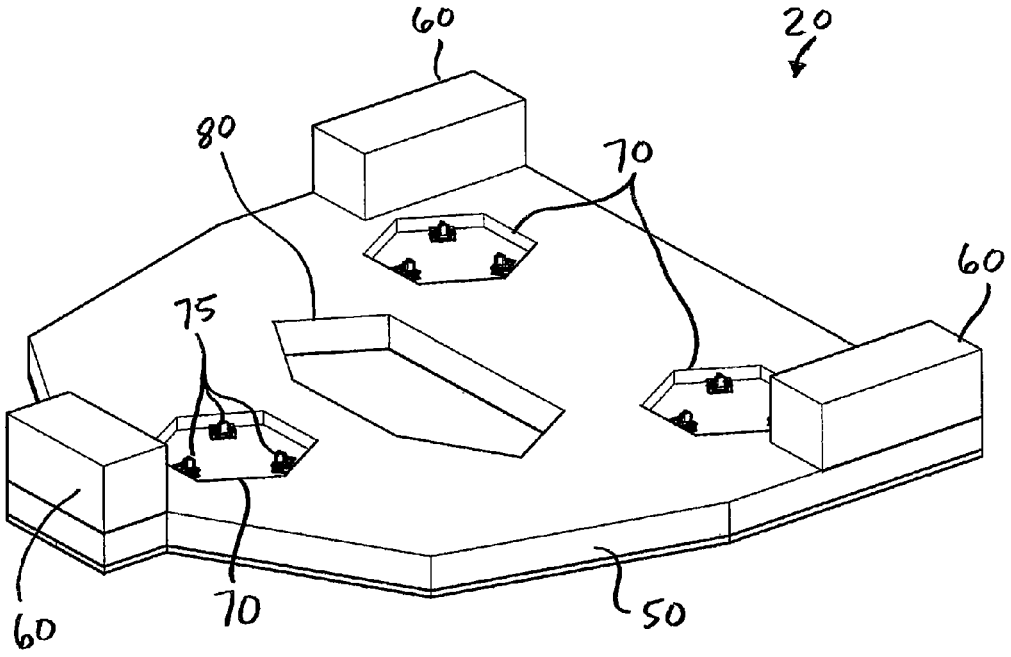
FIGS. 4 and 5 illustrate a mat structure according to one embodiment.
Figure 5:
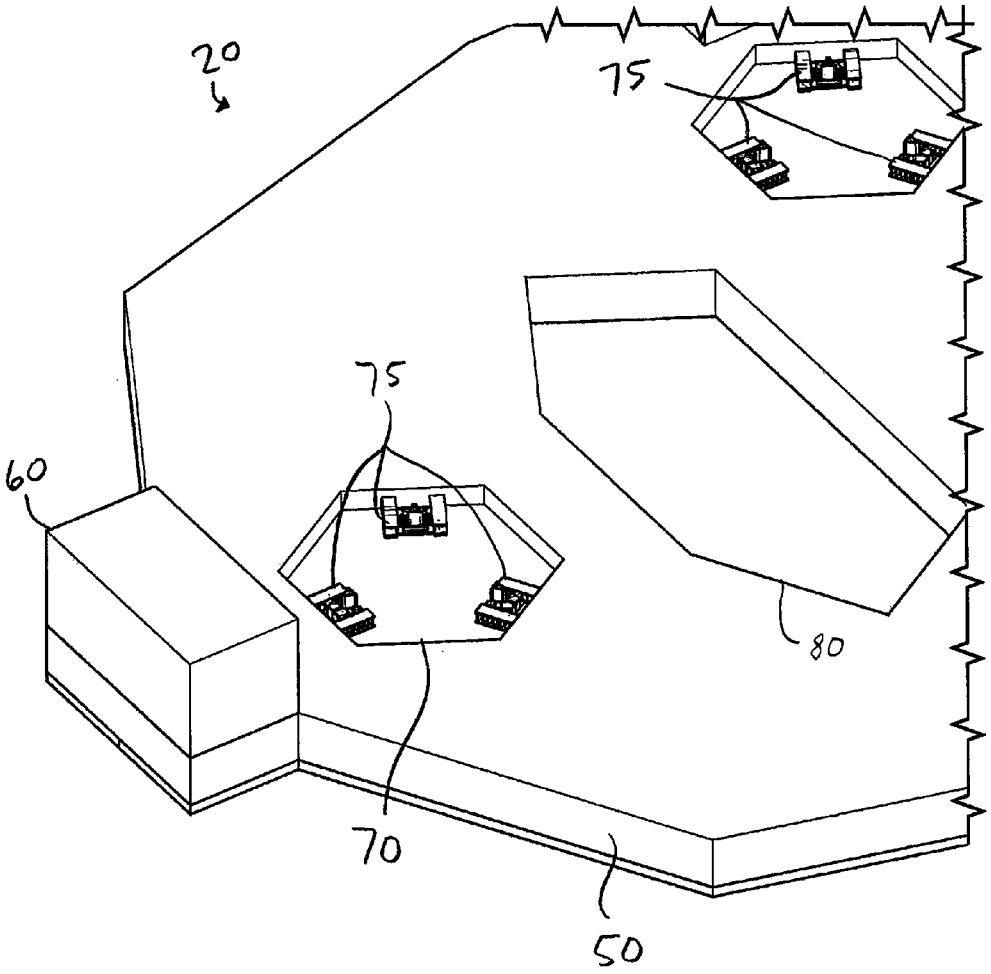

FIGS. 4 and 5 illustrate one or more clamping devices 75 of each locking mechanism 70. As illustrated, each locking mechanism 70 includes three clamping devices 75 for securing the legs 30 to the mat 50. Any number, shape, size, and arrangement of clamping devices 75 may be used for connection to any offshore structure.

Figure 6:
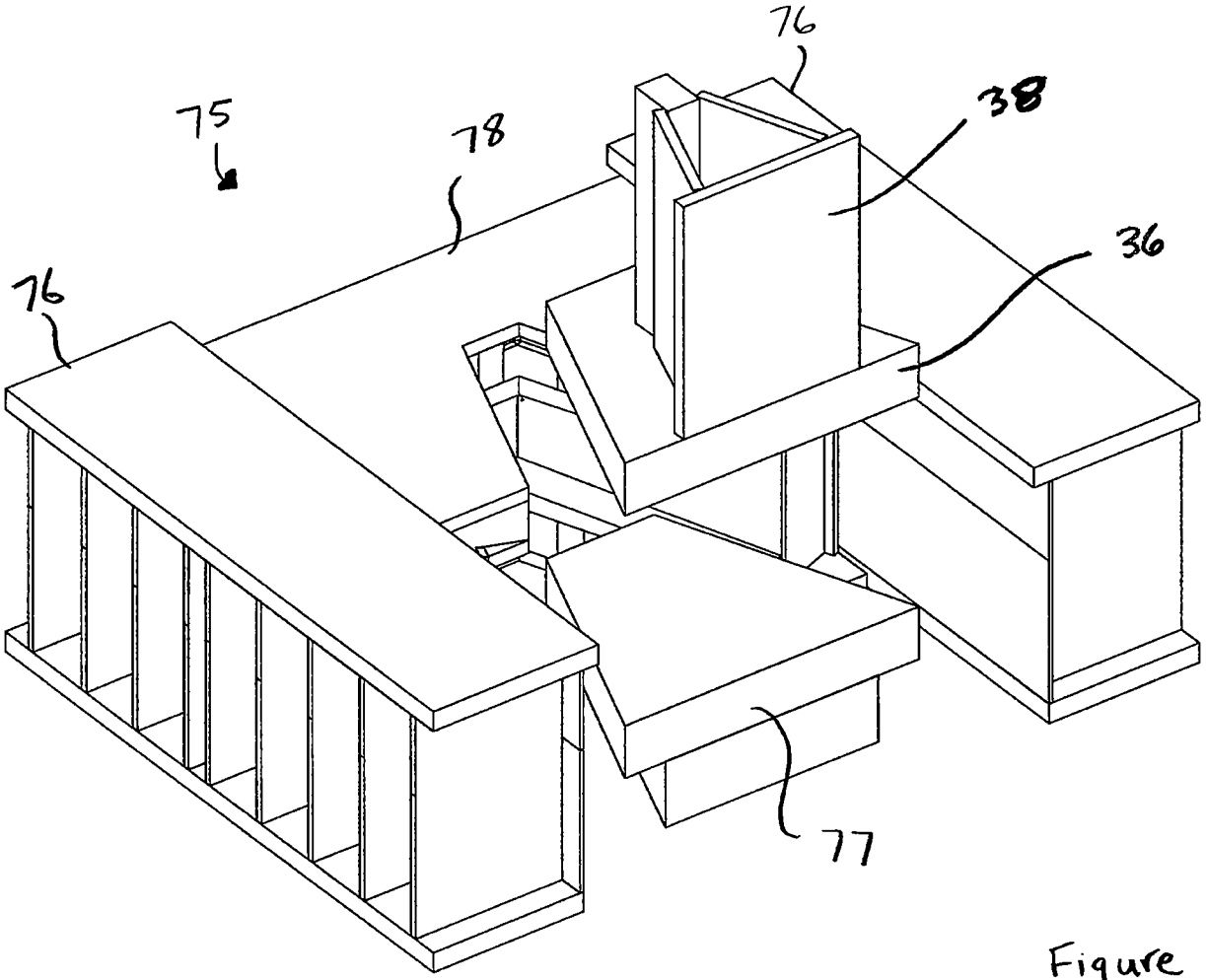
FIGS. 6, 7, and 8 illustrate an operational sequence of a clamping device according to one embodiment.
Figure 7:
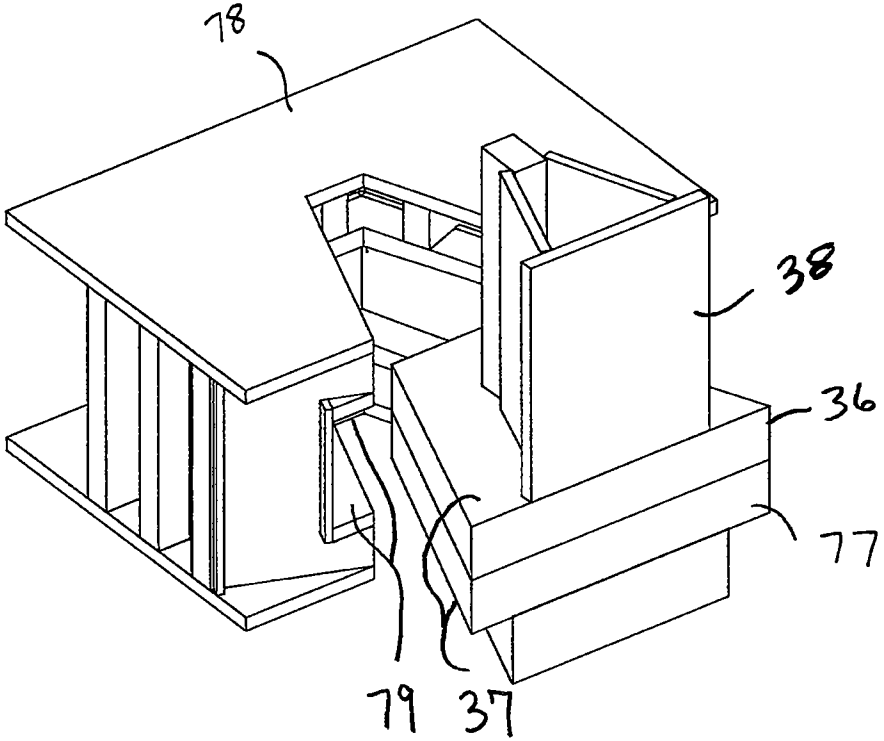
Figure 8:
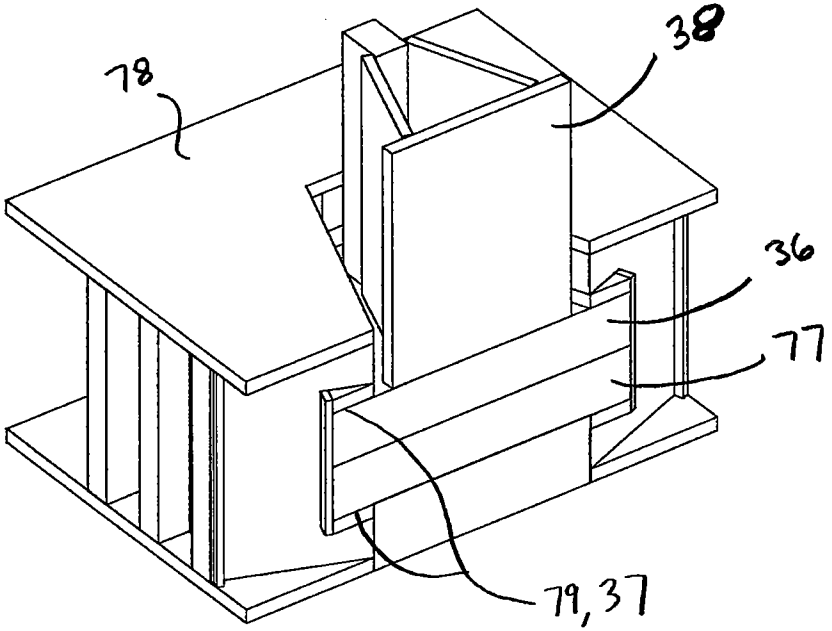

FIGS. 6, 7, and 8 illustrate the connection of a chord 38 of one leg 30 to the clamping device 75. The base 35 of each leg 30 may comprise one or more chords 38, e.g. rigid, structural support sections, for connection to the clamping device 75. Each chord 38 is coupled to a base plate 36 or other flat support structure.

Each clamping device 75 may include a clamp 78, a base plate stool 77, and guide rails 76. The base plate stool 77 is configured to support the base plate 36 coupled to the chord 38. When the base plate 36 is positioned on the base plate stool 77, the clamp 78 is moved along the guide rails 76 into engagement with the base plate 36 and the base plate stool 77. The clamp 78 clamps the base plate 36 to the base plate stool 77, thereby locking the leg 30 to the mat 50.

In one embodiment, the clamp 78, the base plate 36, and the base plate stool 77 may include substantially triangular-shaped profiles for engagement with each other as described herein. In one embodiment, the clamping device 75 may include multiple individual clamps 78 that are moveable into and out of engagement with the base plate 36 and the base plate stool 77 as described herein. In one embodiment, the clamp 78 may be a c-clamp as known in the art to secure the base plate 36 and the base plate stool 77 together as described herein. In one embodiment, the clamp 78 may be mechanically, hydraulically, pneumatically, and/or electronically actuated into and out of engagement with the base plate 36 and the base plate stool 77 as described herein.

FIG. 6 illustrates the base plate 36 positioned above the base plate stool 77. The offshore structure 10 has been moved to a position above the submerged mat 5, such that each leg 30 is in alignment with each corresponding locking mechanism 70. In particular, each chord 38 and base plate 36 of each leg 30 is in alignment with and positioned above each corresponding base plate stool 77 of each clamping device 75 of each locking mechanism 70.

FIG. 7 illustrates the base plate 36 of the chord 38 positioned on the base plate stool 77 (the guide rails 76 have been removed for clarity). When the legs 30 of the offshore structure 10 are properly aligned with each corresponding locking mechanism 70, the legs 30 are lowered to position the base plate 36 of each chord 38 into engagement with each corresponding base plate stool 77. The clamp 78 may then be actuated into engagement with the base plate 36 and the base plate stool 77.

The base plate 36 and the base plate stool 77 each include opposing, outer tapered surfaces 37 that engage opposing, inner tapered surfaces 79 of the clamp 78. The clamp 78 is moved toward the base plate 36 and the base plate stool 77 until the inner tapered surfaces 79 engage the outer tapered surface 37 and wedge or compress the base plate 36 and the base plate stool 77 together. In this manner, the legs 30 of the offshore structure 10 are locked to the mat 5 of the mat structure 20.

FIG. 8 illustrates the clamp 78 fully engaging and enclosing the base plate 36 and the base plate stool 77 (the guide rails 76 have been removed for clarity). The tapered surfaces 79 of the clamp 78 extend substantially across the upper surface of the base plate 36 and the lower surface of the base plate stool 77 to prevent separation of the base plate 36 from the base plate stool 77. When the legs 30 of the offshore structure 10 are locked to the mat structure 10, the legs 30 may be lowered to thereby force the mat structure 20 downward onto the seafloor. To separate the legs 30 from the mat structure 20, the clamp 78 can be retracted to release the base plate 38 from the base plate stool 77.

In one embodiment, one or more mat structures 20 may be coupled to the offshore structure 10. For example, each leg 30 of the offshore structure 10 may be connected to a smaller mat structure 20 independent of the other legs 30. Thus three, smaller mat structures 20 may be coupled one to each individual leg 30 of the offshore structure 10. For another example, one mat structure 20 may be connected to two of the legs 30, while the third leg 30 is connected to a separate mat structure 20. Any number and combination of mat structures 20 may be used to connect with one or more of the legs of any offshore structure.

The embodiments of the invention described herein provide the advantages of converting a single offshore structure into either a concentrated load support system (such as for use with high bearing capacity soil types usually found in deep water environments) or a distributed load support system (such as for use with low bearing capacity soil types usually found in shallow water environments). The offshore structure can be converted at sea using the mat structure without having to bring the offshore structure back to land. The mat structure can be retrofitted to any existing offshore structure, and can be floated out to the offshore structure.

While the foregoing is directed to embodiments of the invention, other and further embodiments of the invention may be devised without departing from the basic scope thereof, and the scope thereof is determined by the claims that follow.

The invention claimed is:

1. An offshore support system, comprising:

an offshore structure having a platform supported by one or more legs; and a mat structure comprising:

a mat;

a clamp configured engage at least one leg of the one or more legs of the offshore structure, the clamp movable into and out of engagement with the at least one leg to connect and release the mat to and from the offshore structure; and one or more stability caissons coupled to the mat, wherein the one or more stability caissons each comprise a floating type structure that provides buoyancy to the mat to allow the mat to float in a position wherein a top of the mat is at substantially the same elevation as a bottom of a hull of the offshore structure and to stabilize the mat when disposing the mat beneath the offshore structure via horizontal movement between the mat structure in the position and the offshore structure for connection of the mat to the offshore structure.

2. The system of claim 1, wherein the one or more legs of the offshore structure are movable into alignment with and above the clamp when in water.

3. The system of claim 1, wherein the clamp of the mat structure is connectable to the at least one leg of the offshore structure at sea.

4. The system of claim 1, wherein the mat comprises one or more pieces of material coupled together.

5. The system of claim 1, wherein a base plate of the at least one leg is positioned on top of a base plate stool of the mat structure, and wherein the clamp is movable into engagement with the base plate and the base plate stool to connect the offshore structure to the mat structure.

6. The system of claim 5, wherein the clamp has internal tapered surfaces configured to engage external tapered surfaces on the base plate and the base plate stool to lock the at least one leg to the mat.

7. The system of claim 5, wherein the clamp comprises a plurality of clamps configured to clamp the base plate and the base plate stool together.

8. A method of connecting a mat structure to an offshore structure, comprising:

positioning a bottom of a hull of the offshore structure and a top of the mat at substantially the same elevation;

disposing the mat structure beneath the offshore structure via horizontal movement between the mat structure and the offshore structure;

positioning at least one leg of the offshore structure into alignment with a clamp of the mat structure by floating the offshore structure over the mat structure as the horizontal movement or by floating the mat under the offshore structure as the horizontal movement to position the at least one leg into alignment with the clamp;

moving the clamp into engagement with the at least one leg to connect the mat structure to the offshore structure while offshore; and lowering the mat structure onto the seafloor subsequent to connecting the mat structure to the at least one leg.

9. The method of claim 8, further comprising stabilizing the mat structure in water using one or more stability caissons coupled to the mat structure.

10. The method of claim 8, further comprising positioning a base plate of the at least one leg onto a base plate stool of the mat structure and moving the clamp into engagement with the base plate and the base plate stool to connected the mat structure to the offshore structure.

11. The method of claim 8, further comprising pulling the offshore structure into alignment with the mat structure using a winch while offshore as the horizontal movement.

12. The method of claim 8, wherein a load of the offshore structure is distributed across the mat structure and onto the seafloor.

13. The method of claim 8, further comprising moving the clamp out of engagement with the at least one leg to disconnect the mat structure from the offshore structure while offshore.

14. The system of claim 1, wherein the mat structure comprises a second clamp configured engage at least one second leg of the one or more legs of the offshore structure, the second clamp movable into and out of engagement with the at least one second leg.

15. The system of claim 1, wherein the mat structure comprises a surface area greater than a surface area of the hull of the offshore structure.

16. The method of claim 8, comprising:

positioning at least one second leg of the offshore structure into alignment with a second clamp of the mat structure;

moving the second clamp into engagement with the at least one second leg to connect the mat structure to the offshore structure while offshore prior to lowering the mat structure onto the seafloor.

17. A device, comprising:

a mat;

a clamp coupled to the mat and configured to engage a first leg of an offshore structure, wherein the clamp is configured to move into and out of engagement with the first leg to connect and release the mat to and from the offshore structure; and a stability caisson coupled to the mat, wherein the stability caisson comprises a floating type structure that provides buoyancy to the mat to allow the mat to float in a position wherein a top of the mat is at substantially the same elevation as a bottom of a hull of the offshore structure and to stabilize the mat when disposing the mat beneath the offshore structure via horizontal movement between the mat in the position and the offshore structure for connection of the mat to the offshore structure.

18. The device of claim 17, comprising a second clamp coupled to the mat and configured to engage a second leg of the offshore structure, wherein the second clamp is configured to move into and out of engagement with the second leg.

19. The device of claim 17, wherein the mat comprises a surface area greater than a surface area of the hull of the offshore structure.

* * * * *